US009829843B2

(12) United States Patent
Kobayashi et al.

(10) Patent No.: US 9,829,843 B2
(45) Date of Patent: Nov. 28, 2017

(54) IMAGE FORMING APPARATUS

(71) Applicant: FUJI XEROX CO., LTD., Tokyo (JP)

(72) Inventors: Yasuyuki Kobayashi, Kanagawa (JP); Tetsuya Furuyama, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/212,394

(22) Filed: Jul. 18, 2016

(65) Prior Publication Data

US 2017/0227903 A1 Aug. 10, 2017

(30) Foreign Application Priority Data

Feb. 8, 2016 (JP) ..... 2016-022020

(51) Int. Cl.
*G03G 15/20* (2006.01)
*G03G 15/00* (2006.01)

(52) U.S. Cl.
CPC ..... *G03G 15/2085* (2013.01); *G03G 15/657* (2013.01); *G03G 15/6558* (2013.01); *G03G 2215/00413* (2013.01)

(58) Field of Classification Search
CPC ..... G03G 15/2085; G03G 15/6558; G03G 15/657; G03G 2215/00413; G03G 15/6561
USPC ..... 399/322, 396
See application file for complete search history.

(56) References Cited

U.S. PATENT DOCUMENTS 5,488,467 A * 1/1996 Marentes ..... G03G 15/652 271/273
2006/0222386 A1* 10/2006 Koshida ..... G03G 15/657 399/44
2008/0317531 A1* 12/2008 Kanai ..... G03G 15/55 399/381
2014/0016957 A1* 1/2014 Suzuki ..... G03G 15/2014 399/67

FOREIGN PATENT DOCUMENTS

JP 2003-182880 A 7/2003
JP 2015-9930 A 1/2015

* cited by examiner

*Primary Examiner* — Sandra Brase
(74) *Attorney, Agent, or Firm* — Sughrue Mion, PLLC

(57) ABSTRACT

An image forming apparatus includes: a pair of transport rollers that nip and transport a recording medium; an image forming device that is disposed on the downstream side of the pair of transport rollers in a recording-medium transport direction and forms an image on the recording medium; a pair of fixing members that are disposed on the downstream side of the image forming device in the recording-medium transport direction and fix the image formed on the recording medium while nipping and transporting the recording medium; a single driving source that rotationally drives both the pair of transport rollers and the pair of fixing members; and a releasing device that stops rotational driving of the pair of transport rollers by the driving source at a timing when the recording medium is transported while being nipped both between the pair of transport rollers and between the pair of fixing members.

12 Claims, 8 Drawing Sheets

IMAGE FORMING APPARATUS

CROSS-REFERENCE TO RELATED APPLICATIONS

This application is based on and claims priority under 35 USC 119 from Japanese Patent Application No. 2016-022020 filed Feb. 8, 2016.

BACKGROUND

Technical Field

The present invention relates to image forming apparatuses.

SUMMARY

According to an aspect of the invention, there is provided an image forming apparatus including: a pair of transport rollers that nip and transport a recording medium; an image forming device that is disposed on the downstream side of the pair of transport rollers in a recording-medium transport direction and forms an image on the recording medium; a pair of fixing members that are disposed on the downstream side of the image forming device in the recording-medium transport direction and fix the image formed on the recording medium while nipping and transporting the recording medium; a single driving source that rotationally drives both the pair of transport rollers and the pair of fixing members; and a releasing device that stops rotational driving of the pair of transport rollers by the driving source at a timing when the recording medium is transported while being nipped both between the pair of transport rollers and between the pair of fixing members.

BRIEF DESCRIPTION OF THE DRAWINGS

Exemplary embodiment of the present invention will be described in detail based on the following figures, wherein.

DETAILED DESCRIPTION

An exemplary embodiment of the present invention will be described in detail below on the basis of the drawings. Note that, for ease of explanation, the direction indicated by an arrow UP shown in FIG. 1 corresponds to the direction of the upper side of an image forming apparatus 10, and the direction indicated by an arrow RH corresponds to the direction of the right side of the image forming apparatus 10. Furthermore, the direction toward the near side with respect to the plane of the sheet of FIG. 1 corresponds to the direction of the front side of the image forming apparatus 10.

Figure 1:
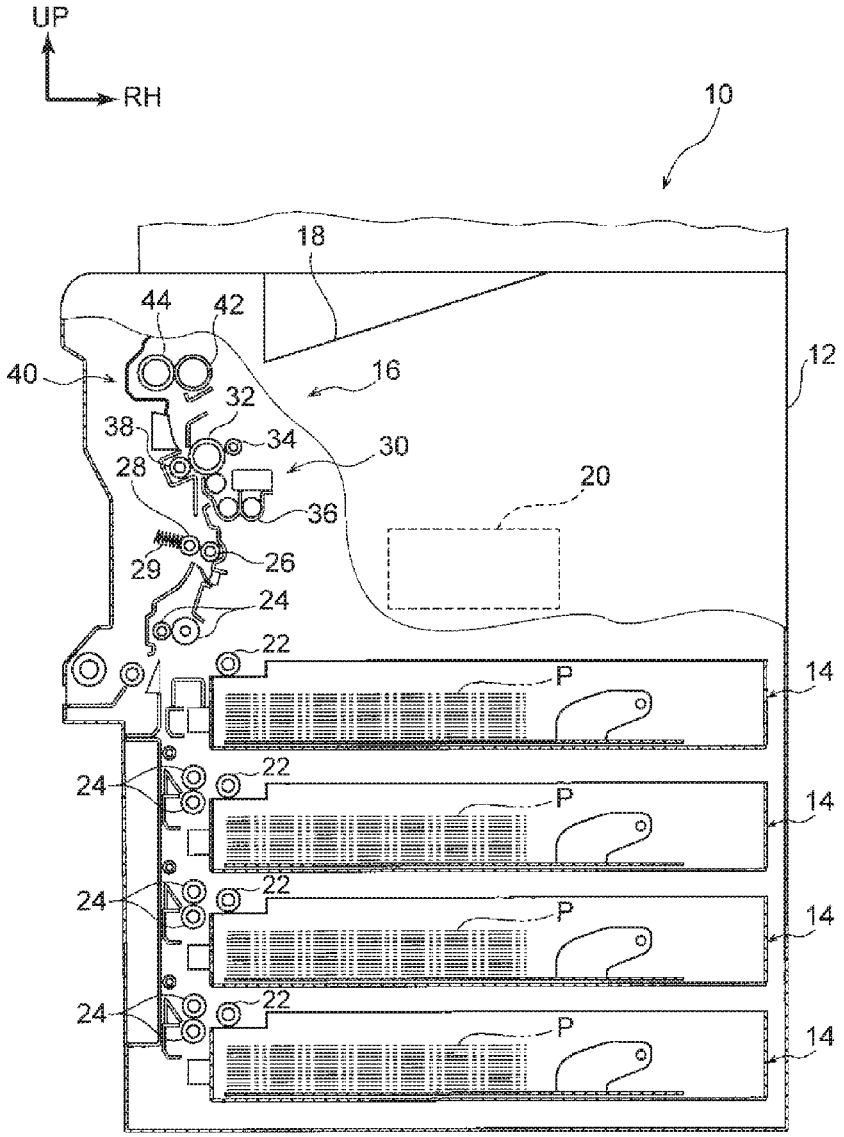
FIG. 1 is a schematic diagram showing the overall configuration of an image forming apparatus according to an exemplary embodiment.

As shown in FIG. 1, the image forming apparatus 10 includes, inside an apparatus body 12, multiple (for example, four) sheet containers 14 for containing sheets P, serving as an example of recording media that vary in size and thickness; an image forming section 16 for forming an image on the sheet P, the image forming section 16 being disposed above the sheet containers 14 and including an image forming unit 30 (described below) and a fixing unit 40; and an image reading section (not shown) for reading an image in an original document, the image reading section being disposed above the image forming section 16.

A feed roller 22, which feeds sheets P contained in the sheet container 14, is provided on the downstream side of each sheet container 14 in the sheet transport direction, and a pair of separation rollers 24 that separate the sheets P fed by the feed roller 22 into individual sheets is provided on the downstream side of the feed roller 22 in the sheet transport direction.

A registration roller 26 and a pinch roller 28, serving as a pair of transport rollers that transport the sheet P toward a transfer position T (described below, see FIG. 2) in accordance with a transfer timing, are provided on the downstream side of the separation rollers 24 in the sheet transport direction. Note that, as shown in FIGS. 1 and 2, the pinch roller 28 is urged against the registration roller 26 by a compression coil spring 29 and is rotated in a driven manner as the registration roller 26 is rotationally driven.

Figure 2:
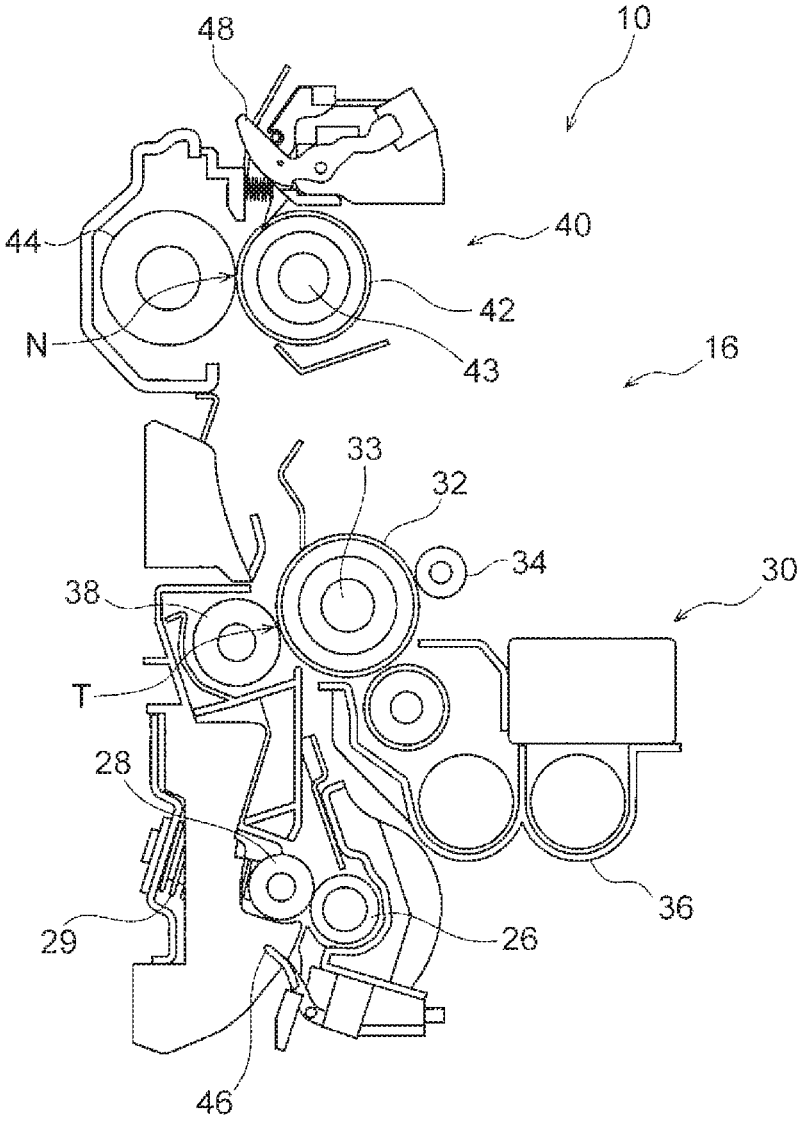
FIG. 2 is an enlarged schematic diagram showing a transport path between a registration roller and a heating roller of the image forming apparatus according to the exemplary embodiment.

Furthermore, as shown in FIG. 2, although the path extending from the registration roller 26 and the pinch roller 28 to a heating roller 42 and a pressure roller 44 (described below) via a transfer position T is the transport path for the sheet P, the image forming apparatus 10 has a reversing path (not shown), in which the sheet P is reversed and transported again to the transfer position T when duplex printing is performed, to the left of the transport path.

Furthermore, a pair of discharge rollers (not shown) are provided on the downstream side of the heating roller 42 and the pressure roller 44 (described below) in the sheet transport direction. The sheet P transported by the pair of discharge rollers is discharged on a discharge part 18 (see FIG. 1) provided in the apparatus body 12 of the image forming apparatus 10.

As shown in FIGS. 1 and 2, the image forming section 16 includes the image forming unit 30, which is disposed on the downstream side of the registration roller 26 and the pinch roller 28 in the sheet transport direction and serves as an example of an image forming device that forms (transfers) a toner image on the sheet P, and the fixing unit 40, which is disposed on the downstream side of the image forming unit 30 in the sheet transport direction and serves as an example of a fixing part that fixes the toner image formed on (transferred to) the sheet P to the sheet P.

The image forming unit 30 includes a cylindrical photoconductor drum 32; a charging roller 34 for charging the surface of the photoconductor drum 32; an LED head (not shown) for irradiating the surface of the charged photoconductor drum 32 with exposure light to form an electrostatic latent image; a developing device 36 for developing the electrostatic latent image formed by the LED head with toner (developer) into a visible image, serving as a toner image; and a transfer roller 38, which is in contact with and rotated in a driven manner by the photoconductor drum 32 and forms, together with the photoconductor drum 32, a transfer position T.

In other words, the image forming unit 30 according to this exemplary embodiment forms (transfers) a toner image to a sheet P by using a known electrophotographic system including charging, exposure, development, and transfer. This image forming unit 30 forms a single-color (for example, black) toner image. Note that, a controller 20 (see FIG. 1), which controls all the operations of the devices and units constituting the image forming apparatus 10, is provided above the sheet containers 14 and to the right of the image forming unit 30.

The fixing unit 40 includes the heating roller 42, which has a cylindrical shape and accommodates a heater (not shown) therein, the heating roller 42 heating and fixing the toner image transferred to the sheet P, and the pressure roller 44 that transports the sheet P while applying pressure, by nipping the sheet P between the pressure roller 44 and the heating roller 42. The heating roller 42 and the pressure roller 44 are an example of a pair of fixing members. The pressure roller 44 is in contact with and rotated in a driven manner by the heating roller 42, and, hereinbelow, the portion where the heating roller 42 and the pressure roller 44 are in contact with each other will be referred to as a nip N (see FIG. 2).

Furthermore, as shown in FIG. 2, a contact-type first sensor 46, which detects the transportation of the sheet P to the registration roller 26 and the pinch roller 28, is provided on the upstream side of the registration roller 26 and the pinch roller 28 in the sheet transport direction. In addition, a contact-type second sensor 48, which detects the transportation (exit) of the sheet P from the heating roller 42 and the pressure roller 44, is provided on the downstream side of the heating roller 42 and the pressure roller 44 in the sheet transport direction.

Figure 3:
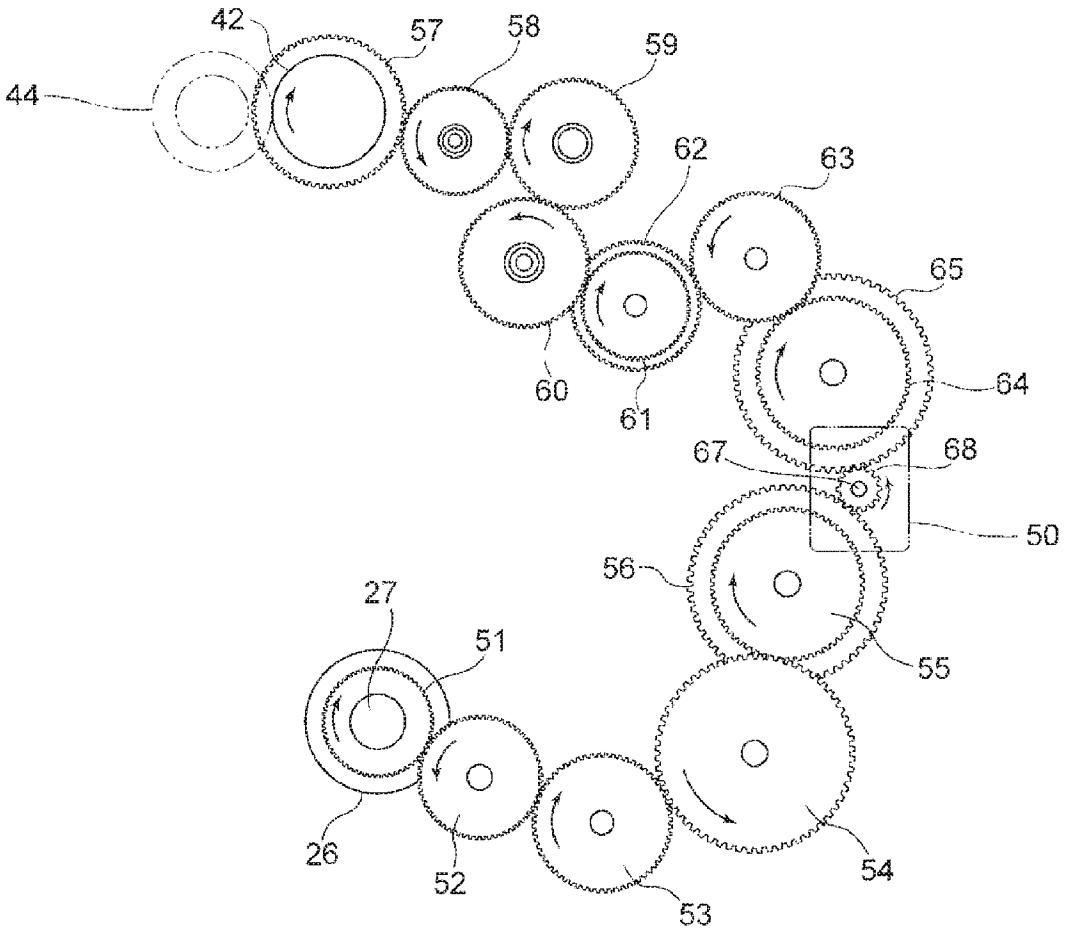
FIG. 3 is a schematic diagram showing a single driving motor and gears for driving the registration roller and the heating roller of the image forming apparatus according to the exemplary embodiment.
Figure 4B:
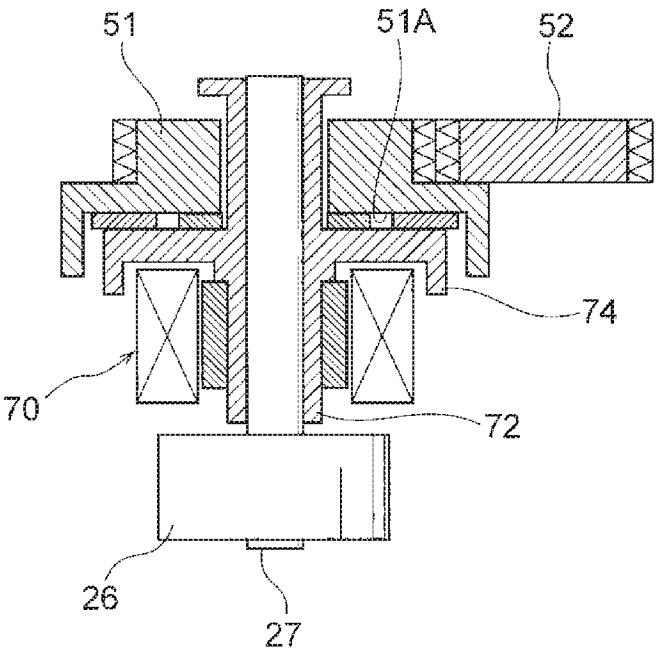
FIGS. 4A and 4B are schematic diagrams showing a non-energized state and an energized state, respectively, of an electromagnetic clutch provided on the registration roller of the image forming apparatus according to the exemplary embodiment.
Figure 4A:
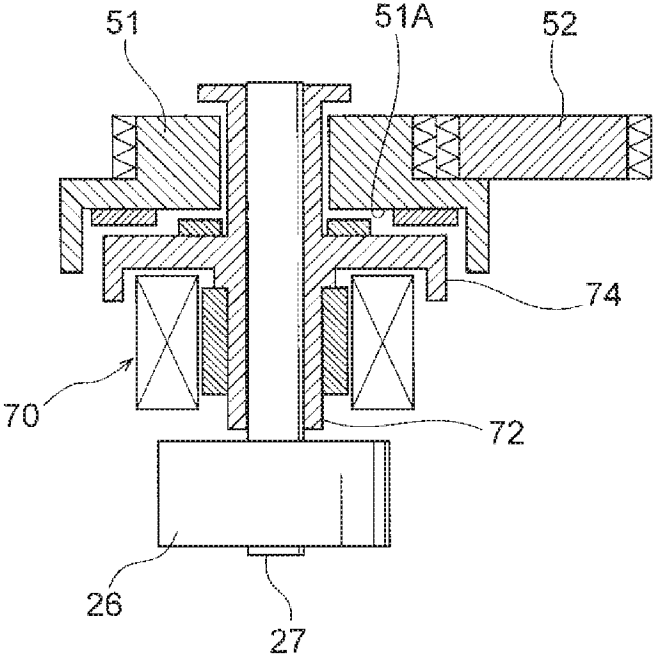

Furthermore, as shown in FIG. 3, the registration roller 26 and the heating roller 42 are rotationally driven by a single driving motor 50, serving as an example of a single driving source. More specifically, as shown in FIGS. 4A and 4B, the registration roller 26 is fixed to one end of a rotation shaft 27 in the axial direction, and a cylindrical body part 72 of an electromagnetic clutch 70 (described below) is securely fitted thereto.

An annular clutch plate 74 is formed integrally with the outer circumferential surface of the body part 72, substantially in the middle thereof in the axial direction, and a first gear 51 is rotatably fitted to the other end of the body part 72 (rotation shaft 27) in the axial direction so as to face the clutch plate 74 in the axial direction. The first gear 51 is meshed with a second gear 52.

As shown in FIG. 3, the second gear 52 is meshed with a third gear 53, and the third gear 53 is meshed with a fourth gear 54. In addition, the fourth gear 54 is meshed with a fifth gear 55, and a sixth gear 56 that is coaxially fixed to the fifth gear 55 is meshed with a driving gear 68 that is fixed to a rotation shaft 67 of the driving motor 50.

Meanwhile, a seventh gear 57 is coaxially fixed to one end, in the axial direction, of the rotation shaft 43 (see FIG. 2) that is fixed to the heating roller 42. The seventh gear 57 is meshed with the eighth gear 58. The eighth gear 58 is meshed with a ninth gear 59, and the ninth gear 59 is meshed with a tenth gear 60.

Furthermore, an eleventh gear 61 is meshed with the tenth gear 60, and a twelfth gear 62 that is coaxially fixed to the eleventh gear 61 is meshed with a thirteenth gear 63. The thirteenth gear 63 is meshed with a fourteenth gear 64, and a fifteenth gear 65 that is coaxially fixed to the fourteenth gear 64 is meshed with a driving gear 68 that is fixed to the rotation shaft 67 of the driving motor 50.

Furthermore, as shown in FIGS. 4A and 4B, the electromagnetic clutch 70, serving as an example of a releasing device, is provided on the rotation shaft 27 of the registration roller 26. The electromagnetic clutch 70 is a known electromagnetic clutch, and, when energized, as shown in FIG. 4B, the clutch plate 74 is attached to an opposing surface 51A, which is oriented in the axial direction of the first gear 51, thereby transmitting the rotational driving force of the first gear 51 to the registration roller 26. In this way, the registration roller 26 and the heating roller 42 are rotationally driven by the single driving motor 50.

When energization of the electromagnetic clutch 70 is stopped, as shown in FIG. 4A, the clutch plate 74 is released from the opposing surface 51A, which is oriented in the axial direction of the first gear 51, thereby stopping the transmission of the rotational driving force of the first gear 51 to the registration roller 26. In other words, at this time, the registration roller 26 is freely rotatable. As will be described below, the timing when energization of the electromagnetic clutch 70 is stopped is the timing when the sheet P is transported both by the registration roller 26 and the pinch roller 28 and by the heating roller 42 and the pressure roller 44.

The sheet P in this exemplary embodiment is thick paper. In this exemplary embodiment, the thick paper has a grammage of 106 g/m$^2$ or more. More specifically, thick paper having a grammage of 157 g/m$^2$ and a thickness of 180 μm or 184 μm, and thick paper having a grammage of 209 g/m$^2$ and a thickness of 236 μm or 247 μm are used. Note that the thick paper serving as an example of the sheet P according to this exemplary embodiment is not limited thereto, and anything that is at least printable and is recognized as "thick paper" may be used.

Figure 5:
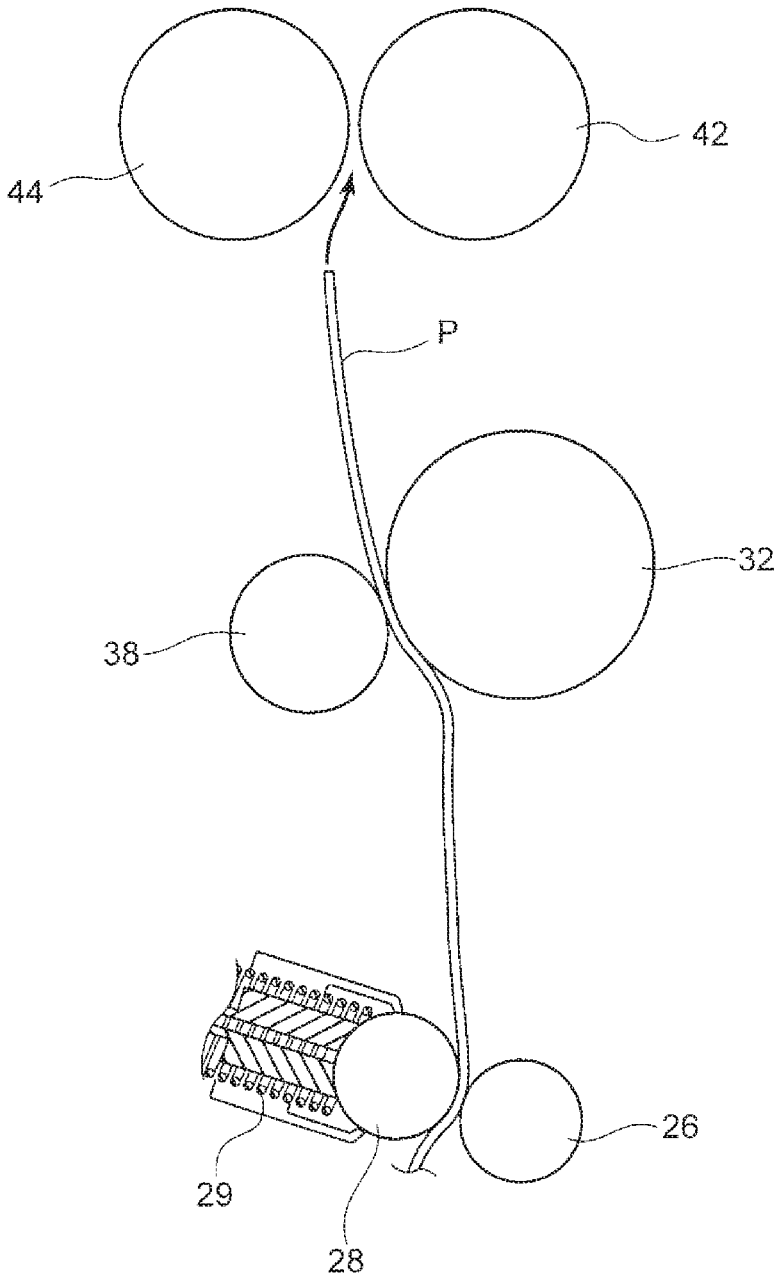
FIG. 5 is a diagram showing a state in which a sheet is transported by the registration roller and a pinch roller of the image forming apparatus according to the exemplary embodiment.

The operation of the image forming apparatus 10 having the above-described configuration will be described below primarily with reference to FIGS. 5 to 7.

When the image forming apparatus 10 receives image data, a toner image is formed on the photoconductor drum 32 of the image forming unit 30. In the meantime, sheets P are fed from the sheet container 14 by the feed roller 22, separated into individual sheets by the separation rollers 24, and transported to the registration roller 26 and the pinch roller 28.

At this time, the first sensor 46 detects that the sheet P has been transported to the registration roller 26 and the pinch roller 28, and the time when the sheet P will be transported to the nip N between the heating roller 42 and the pressure roller 44 is calculated by the controller 20, which controls the rotation speed of the registration roller 26 and the heating roller 42.

The sheet P transported to the registration roller 26 and the pinch roller 28 is transported while being nipped between the registration roller 26 and the pinch roller 28 and is transported to the transfer position T in accordance with the transfer timing at which the toner image formed on the photoconductor drum 32 is transferred. As the sheet P is transported while being nipped between the transfer roller 38 and the photoconductor drum 32, the toner image on the photoconductor drum 32 is transferred to the sheet P.

The sheet P to which the toner image has been transferred is transported to the fixing unit 40 and is fed into the nip N, where the heating roller 42 and the pressure roller 44 are in contact with each other. Herein, the rotation speed of the heating roller 42 is lower than that of the registration roller 26 by several percent. In other words, the sheet transport speed of the heating roller 42 is lower than that of the registration roller 26 by several percent.

Hence, when the sheet P is normal paper and is transported while being nipped both between the registration roller 26 and the pinch roller 28 and between the heating roller 42 and the pressure roller 44, due to the difference in sheet transport speed therebetween, a so-called loop (curve) is formed in a portion of the sheet P between the image forming unit 30 (the photoconductor drum 32 and the transfer roller 38) and the fixing unit 40 (the heating roller 42 and the pressure roller 44) (normal paper mode).

This loop (curve) formed in the sheet P absorbs the difference in speed generated when the sheet P has passed through the nip between the registration roller 26 and the pinch roller 28. In other words, in the normal paper mode, an image defect due to the difference in sheet transport speed is suppressed or prevented by the loop (curve). However, because the sheet P according to this exemplary embodiment is thick paper, as shown in FIGS. 5 to 7, the loop (curve) is less likely to be formed in a portion of the sheet P that has passed through the nip between the transfer roller 38 and the photoconductor drum 32 (thick-paper mode).

In this case, if the registration roller 26 and the heating roller 42 are rotationally driven by different driving motors, their rotation speeds can be individually controlled, and thus, it is possible to absorb the difference in speed generated when the sheet P has passed through the nip between the registration roller 26 and the pinch roller 28. However, because the registration roller 26 and the heating roller 42 according to this exemplary embodiment are rotationally driven by the single driving motor 50, their rotation speeds cannot be controlled by the driving motor 50.

Figure 6:
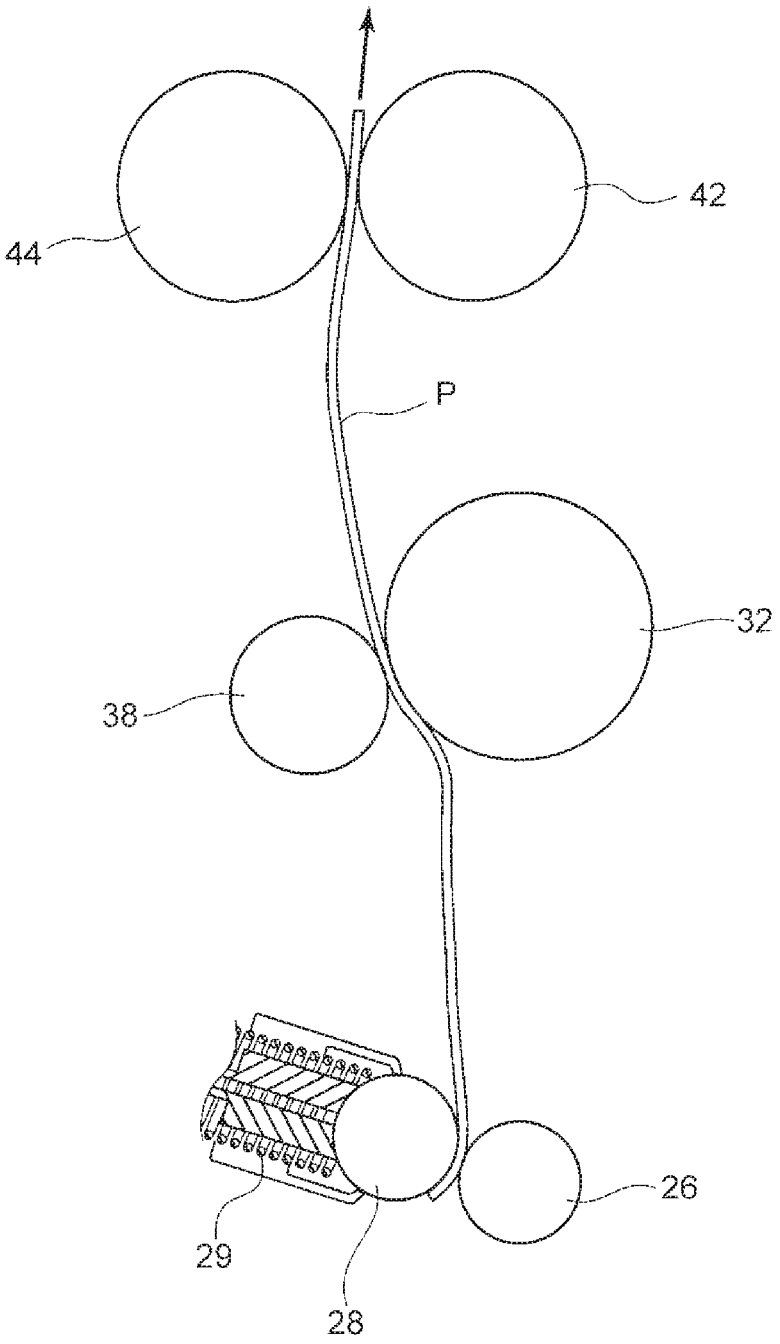
FIG. 6 is a diagram sowing a state in which a sheet is transported both by the registration roller and the pinch roller and by the heating roller and a pressure roller of the image forming apparatus according to the exemplary embodiment.
Figure 7:
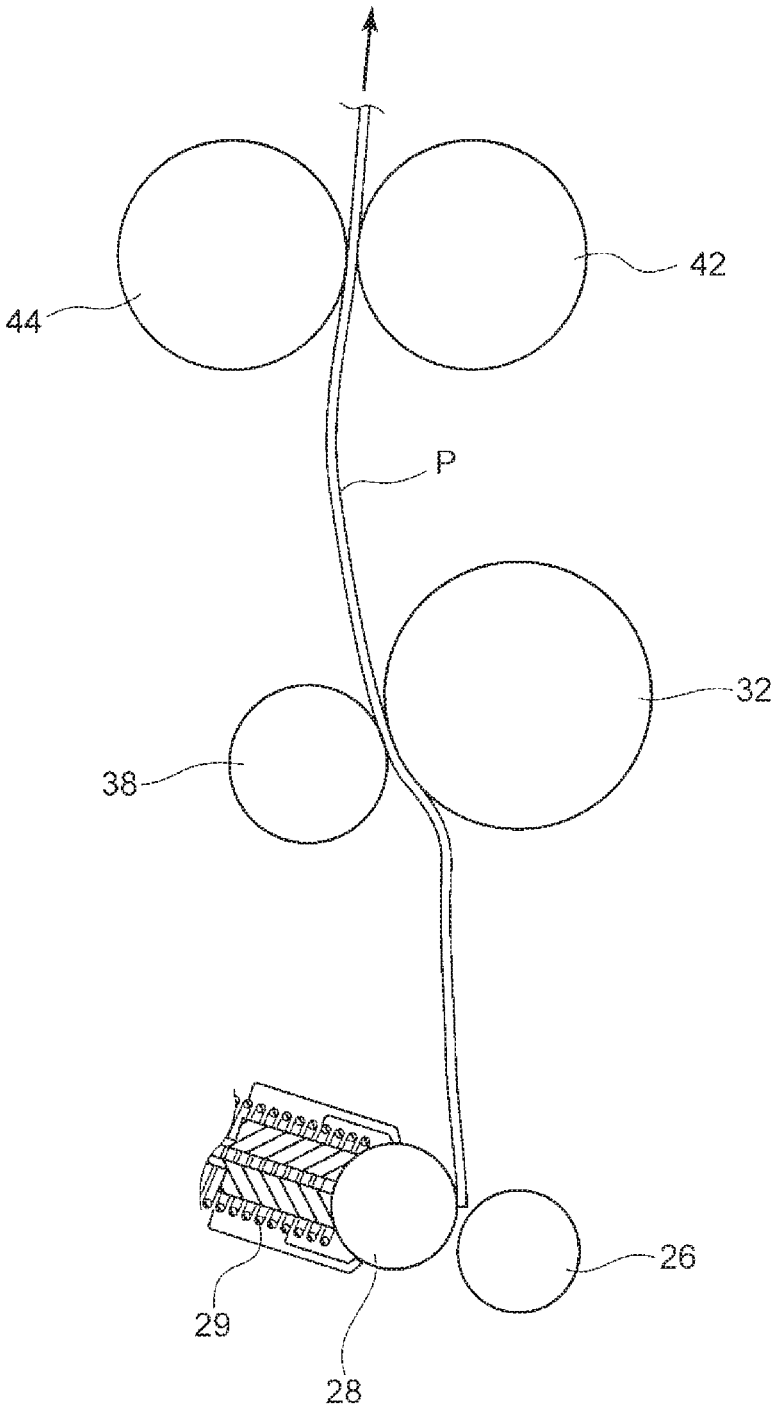
FIG. 7 is a diagram sowing a state in which a sheet is transported by the heating roller and the pressure roller of the image forming apparatus according to the exemplary embodiment.

Hence, as shown in FIG. 6, in the thick-paper mode, at the timing when the leading end of the sheet P in the transport direction has been fed into the nip N, where the heating roller 42 and the pressure roller 44 are in contact with each other, that is, at the timing when the sheet P is transported while being nipped both between the registration roller 26 and the pinch roller 28 and between the heating roller 42 and the pressure roller 44, the rotational driving of the registration roller 26 is shut off (stopped), so that the sheet P is not transported by the registration roller 26 and the pinch roller 28. A description will be given below.

The sheet P (thick sheet) to which the toner image has been transferred is transported to the fixing unit 40 and is fed into the nip N, where the heating roller 42 and the pressure roller 44 are in contact with each other. Herein, the timing when the sheet P (thick paper) is fed into the nip N between the heating roller 42 and the pressure roller 44 has been calculated by the controller 20 on the basis of the detection by the first sensor 46.

Thus, the controller 20 stops energization of the electromagnetic clutch 70 at the calculated timing, shutting off the rotational driving force from the driving motor 50 to the registration roller 26. As a result, the registration roller 26 becomes freely rotatable, and the sheet P (thick paper) is transported toward the downstream side in the transport direction by the rotational driving force transmitted from the driving motor 50 to the heating roller 42.

Hence, the generation of the difference in sheet transport speed at the transfer position T, where the sheet P is nipped between the photoconductor drum 32 and the transfer roller 38, is suppressed or prevented, and, even when a sheet P (thick paper) in which the loop (curve) is less likely to be formed is used, an image defect (smudge) of the toner image to be transferred to the sheet P (thick paper) is suppressed or prevented.

Furthermore, at the timing when energization of the electromagnetic clutch 70 is stopped, the controller 20 controls the rotation speed of the heating roller 42 so as to be equal to the rotation speed of the registration roller 26 when the electromagnetic clutch 70 has been energized. In other words, when energization of the electromagnetic clutch 70 is stopped, the sheet transport speed of the heating roller 42 is made equal to that of the registration roller 26 that has been rotationally driven by the driving motor 50.

Accordingly, when the leading end of the sheet P (thick paper) in the transport direction is fed into the nip N, where the heating roller 42 and the pressure roller 44 are in contact with each other, the difference in speed corresponding to the amount by which the sheet P (thick paper) has been transported (pushed up) by the registration roller 26 that has been rotationally driven by the driving motor 50 is absorbed. Thus, an image defect (smudge) of the toner image to be transferred to the sheet P (thick paper) is more reliably suppressed or prevented.

When the second sensor 48 has detected the exit of the leading end of the sheet P (thick paper) in the transport direction from the nip N, where the heating roller 42 and the pressure roller 44 are in contact with each other, the timing when the trailing end of the sheet P (thick paper) in the transport direction will pass through the nip N between the heating roller 42 and the pressure roller 44 is calculated by the controller 20, which controls the rotation speed of the heating roller 42.

At the timing when the trailing end of the sheet P (thick paper) in the transport direction has passed through the nip N between the heating roller 42 and the pressure roller 44, the image forming apparatus 10 is returned to the initial state, that is, the normal paper mode. More specifically, the electromagnetic clutch 70 is energized, the heating roller 42 and the registration roller 26 are rotationally driven by the single driving motor 50, and the sheet transport speed of the registration roller 26 is set faster than that of the heating roller 42.

Furthermore, as has been described above, in the image forming apparatus 10 according to this exemplary embodiment, the registration roller 26 and the heating roller 42 are rotationally driven by the single driving motor 50. Hence, compared with an image forming apparatus in which the registration roller 26 and the heating roller 42 are rotationally driven by separate driving motors, the size and manufacturing cost of the image forming apparatus 10 can be reduced.

Figure 8:
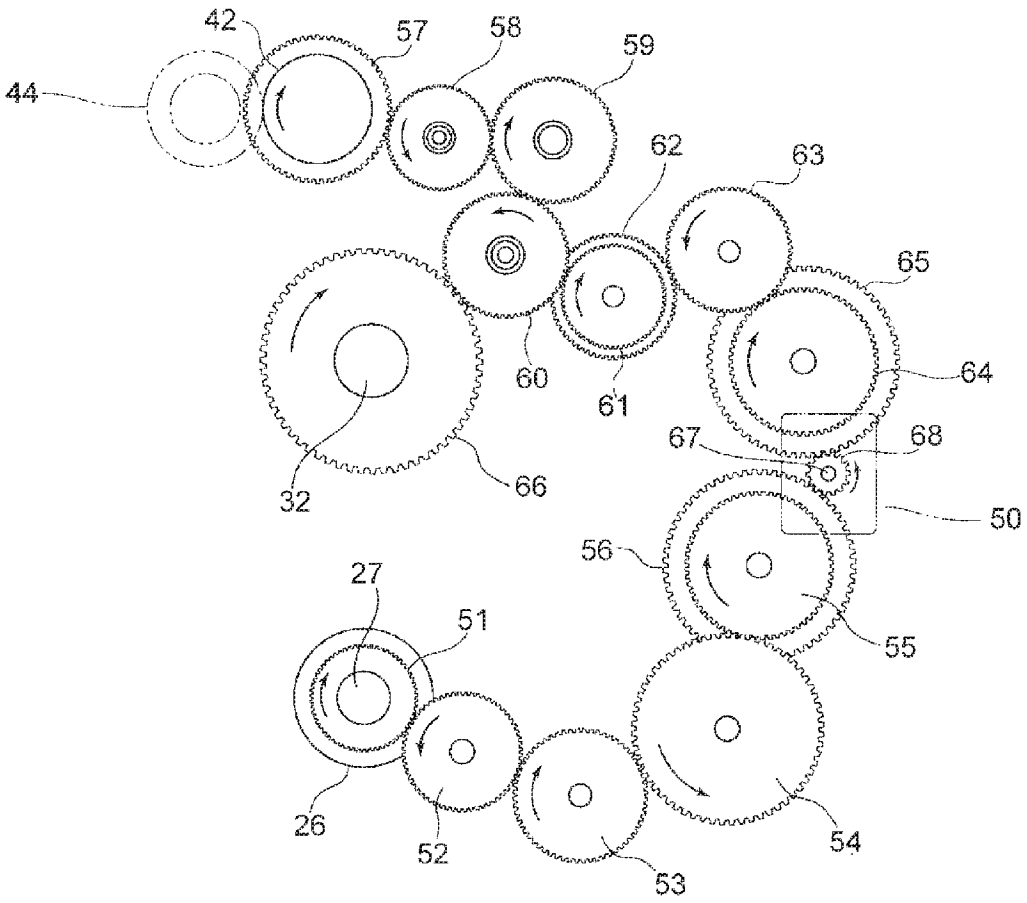
FIG. 8 is a schematic diagram showing a single driving motor and gears for driving the registration roller, the heating roller, and a photoconductor drum of the image forming apparatus according to the exemplary embodiment.

Although the image forming apparatus 10 according to this exemplary embodiment has been described above on the basis of the drawings, the image forming apparatus 10 according to this exemplary embodiment is not limited to that illustrated, and it may be appropriately modified within a scope not departing from the spirit of the present invention. For example, as shown in FIG. 8, a sixteenth gear 66 may be axially fixed to one end, in the axial direction, of a rotation shaft 33 of the photoconductor drum 32 (see FIG. 2), and the sixteenth gear 66 may be meshed with the tenth gear 60, thereby making the driving motor 50 rotate the photoconductor drum 32.

In short, it is only necessary that the image forming apparatus 10 according to this exemplary embodiment be configured such that at least the registration roller 26 and the heating roller 42 are rotationally driven by the single driving motor 50. Furthermore, the electromagnetic clutch 70 may be configured such that, when not energized, the clutch plate 74 is attached to the opposing surface 51A of the first gear 51 and such that, when energized, the clutch plate 74 is released from the opposing surface 51A of the first gear 51 (i.e., the configuration opposite to the above-described configuration).

Furthermore, the sheet P according to this exemplary embodiment is not limited to thick paper, and the operation according to this exemplary embodiment may be performed on, for example, normal paper. In addition, although the fixing member is formed of a roller pair in this exemplary embodiment, for example, one or both of them may be a belt. When a belt is used, rollers over which the belt is stretched and the transport rollers are driven by a single driving source.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a pair of transport rollers that nip and transport a recording medium;

an image forming device that is disposed on the downstream side of the pair of transport rollers in a recording-medium transport direction and forms an image on the recording medium;

a pair of fixing members that are disposed on the downstream side of the image forming device in the recording-medium transport direction and fix the image formed on the recording medium while nipping and transporting the recording medium;

a single driving source that rotationally and simultaneously drives both the pair of transport rollers and the pair of fixing members; and a releasing device that stops rotational driving of the pair of transport rollers by the driving source at a timing when the recording medium is transported while being nipped both between the pair of transport rollers and between the pair of fixing members.

2. The image forming apparatus according to claim 1, wherein the recording medium is thick paper.

3. The image forming apparatus according to claim 1, wherein the releasing device comprises a clutch.

4. The image forming apparatus according to claim 1, further comprising a driving gear that is driven by the single driving motor, at least one upstream gear disposed between the driving gear and one of the transport rollers, and at least one downstream gear disposed between the driving gear and one of the fixing rollers.

5. The image forming apparatus according to claim 1, wherein a recording-medium transport speed of the pair of transport rollers that are rotationally driven by the driving source is higher than the recording-medium transport speed of the pair of fixing members that are rotationally driven by the driving source, and, at the timing when rotational driving of the pair of transport rollers by the driving source is stopped, the recording-medium transport speed of the pair of fixing members is made equal to the recording-medium transport speed of the pair of transport rollers that have been rotationally driven by the driving source.

6. An image forming apparatus comprising:

a pair of transport rollers that nip and transport a recording medium;

an image forming device that is disposed on the downstream side of the pair of transport rollers in a recording-medium transport direction and forms an image on the recording medium;

a pair of fixing members that are disposed on the downstream side of the image forming device in the recording-medium transport direction and fix the image formed on the recording medium while nipping and transporting the recording medium;

a single driving source that rotationally drives both the pair of transport rollers and the pair of fixing members; and a releasing device that stops rotational driving of the pair of transport rollers by the driving source at a timing when the recording medium is transported while being nipped both between the pair of transport rollers and between the pair of fixing members, wherein a recording-medium transport speed of the pair of transport rollers that are rotationally driven by the driving source is higher than the recording-medium transport speed of the pair of fixing members that are rotationally driven by the driving source, and, at the timing when rotational driving of the pair of transport rollers by the driving source is stopped, the recording-medium transport speed of the pair of fixing members is made equal to the recording-medium transport speed of the pair of transport rollers that have been rotationally driven by the driving source.

7. The image forming apparatus according to claim 6, wherein the recording medium is thick paper.

8. An image forming apparatus comprising:

transport rollers;

an image forming device that is disposed downstream of the transport rollers;

fixing rollers that are disposed downstream of the image forming device;

a single driving motor that simultaneously and rotationally drives one of the transport rollers and one of the fixing rollers; and a clutch that disengages rotation of the one of the transport rollers at a timing when a recording medium is transported while being nipped both between the transport rollers and between the fixing rollers.

9. The image forming apparatus according to claim 8, comprising a driving gear that is driven by the single driving motor, at least one upstream gear disposed between the driving gear and the one of the transport rollers, and at least one downstream gear disposed between the driving gear and the one of the fixing rollers.

10. The image forming apparatus according to claim 9, wherein the clutch engages and disengages with one of the at least one upstream gear.

11. The image forming apparatus according to claim 8, wherein the clutch is an electromagnetic clutch.

12. The image forming apparatus according to claim 11, comprising a controller that controls the clutch to engage the clutch, and to disengage the clutch at the timing.

* * * * *